United States Patent [19]

Weidler

[11] Patent Number: 4,486,950

[45] Date of Patent: Dec. 11, 1984

[54] METHOD OF MAKING TWO ROW ELECTRICAL CONNECTOR

[75] Inventor: Charles H. Weidler, Lancaster, Pa.

[73] Assignee: AMP Incorporated, Harrisburg, Pa.

[21] Appl. No.: 407,381

[22] Filed: Aug. 12, 1982

Related U.S. Application Data

[62] Division of Ser. No. 189,532, Sep. 22, 1980, Pat. No. 4,354,719.

[51] Int. Cl.[3] ..... H01R 43/04

[52] U.S. Cl. ..... 29/866

[58] Field of Search ..... 29/857, 861, 866; 339/198 H, 97 R, 99 R, 198 N, 198 P, 208, 65, 75, 97 P, 217 S

[56] References Cited

U.S. PATENT DOCUMENTS

| | | | |
|---|---|---|---|
| 3,569,900 | 3/1971 | Uberbacker | 339/217 S X |
| 3,879,099 | 4/1975 | Shaffer | 339/99 R |
| 4,243,288 | 1/1981 | Lucius et al. | 339/99 R |
| 4,278,314 | 7/1981 | Moser et al. | 339/99 R |
| 4,327,956 | 5/1982 | Sitzler | 339/97 R X |
| 4,343,085 | 8/1982 | Lucius et al. | 29/857 X |

*Primary Examiner*—Howard N. Goldberg
*Assistant Examiner*—Carl J. Arbes
*Attorney, Agent, or Firm*—F. W. Rarig

[57] ABSTRACT

Two row electrical connector is manufactured by positioning a pair of connector modules in side-by-side relationship with the terminals in the two modules arranged as a single row. Wires are located in side-by-side relationship with each wire in alignment with one of the terminals. The wires are moved laterally into the wire-connecting portions of the terminals and connected to the terminals. The two modules are then positioned against each other in aligned relationship with the terminals forming two parallel rows and the modules are secured to each other.

6 Claims, 4 Drawing Figures

METHOD OF MAKING TWO ROW ELECTRICAL CONNECTOR

This application is a division of application Ser. No. 189,532 filed Sept. 22, 1980 and now U.S. Pat. No. 4,354,719 issued Oct. 19, 1982.

BACKGROUND OF THE INVENTION

This invention relates to a method of manufacturing an electrical connector of the type having two parallel rows of terminals in the connector housing.

It is widespread practice in many branches of the electrical industry to disengageably connect groups or bundles of wires to each other by providing multi-contact electrical connectors on the ends of the wires of the bundles. Each connector contains a plurality of contact terminals and each wire is connected to one of the terminals. The wires can thus be connected to each other by merely mating the two connectors with each other.

A variety of types of connectors, as regards the arrangement of the terminals in the connector and the means of connecting the wires to the terminals, are being used. The wires may be soldered to the terminals in the connector housing or electrical terminals can be crimped onto the ends of the wires and the terminals thereafter inserted into cavities in the connector housing. Connectors of these two types have long been used and more recently, a type of connector has been introduced which has therein terminals of a type having wire-receiving slots so that the wires can be connected to the terminals by merely moving the wires laterally of their axes and into the slots. The introduction of wire-in-slot type terminals has resulted in greatly improved methods of assembling multi-contact electrical connectors to wires and has resulted in the achievement of substantial economies in the industry. For example, U.S. Pat. No. 4,043,017 shows a machine which is capable of positioning wires in alignment with terminals in a connector and simultaneously inserting the wires into the terminals in the connector. In each operating cycle of this type of assembly machine then, a harness subassembly is produced consisting of a connector having wires extending from each of its terminals. Another benefit which as been realized from the introduction of wire-in-slot type terminals is disclosed in U.S. Pat. No. 3,859,724 which teaches a method of producing electrical harnesses by simply positioning the connectors as required on a harness board, lacing wires over the harness board in accordance with the wiring plan of the harness, and inserting the wires into the terminals in the connectors on the harness board. This manufacturing method has substantially shortened the amount of time required to produce a harness and has greatly reduced the amount of labor required in harness manufacturing operations.

The assembly machine disclosed on the above identified U.S. Pat. No. 4,043,017 and the harness manufacturing method taught in U.S. Pat. No. 3,859,724 can be practiced only with single row electrical connectors, that is, electrical connectors in which all of the terminals are arranged in a single row in side-by-side relationship. While widespread use is made of single row electrical connectors, there is also a substantial need for two row electrical connectors, that is, connectors which have two rows of contact terminals therein, the rows being side-by-side and parallel to each other.

The present invention is directed to the achievement of an improved method of manufacturing two row electrical connectors which is compatible with the above identified U.S. Pat. Nos. 4,043,017 and 3,859,724.

In accordance with the method of the present invention, a pair of connector modules are positioned in side-by-side relationship, the modules having terminals therein which have wire-connecting portions. When the modules are in side-by-side relationship, the terminals in the modules are arranged as a single row. A plurality of wires are located in side-by-side relationship in a single plane with each wire in alignment with one of the terminals. The wires are thereafter moved laterally of their axes and to the wire-connecting portions of the terminals and connected to the terminals. The modules are then positioned against each other in aligned relationship with the terminals in the modules forming two parallel rows. Finally, the modules are secured to each other to form the two row connector assembly. In accordance with further embodiments, a cover is assembled to the modules. The cover serves as the housing and surrounds the modules completely and may be assembled to the modules prior to the step of positioning the modules against each other.

The wire-connecting portions of the terminals are advantageously in the form of wire-receiving slots of the commonly known type. However, the principles of the invention can be practiced with other types of wire-connecting portions. For example, the terminals may be crimped onto the wires after the wires are located in the terminals.

PRACTICE OF THE INVENTION

Figure 3:
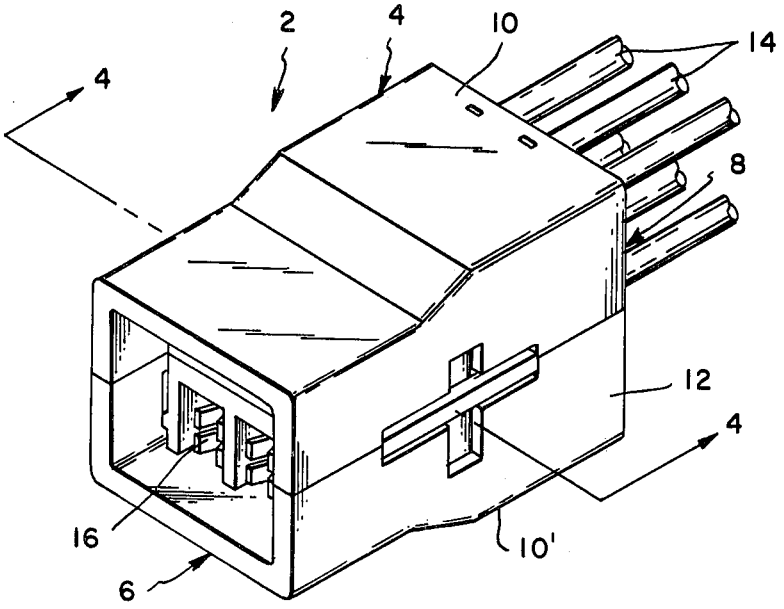
FIG. 3 is a perspective view of a fully assembled connector in accordance with the invention.

A connector assembly 2, FIG. 3, in accordance with the invention, comprises a housing assembly 4 having a mating face 6, a wire entry face 8 upwardly and downwardly facing (as viewed in drawing) sidewalls 10, 10' and laterally facing endwalls 12, 12'. Wires 14 extend into the housing assembly at the wire entry face 8 and are connected to terminals 16 which are contained in the housing, as will be described below.

Structural details of the connector assembly can best be understood from a description of the component parts of the assembly and the manner in which wires are connected to the terminals in the assembly and the parts of the assembly brought together to produce the finished connector.

Figure 1:
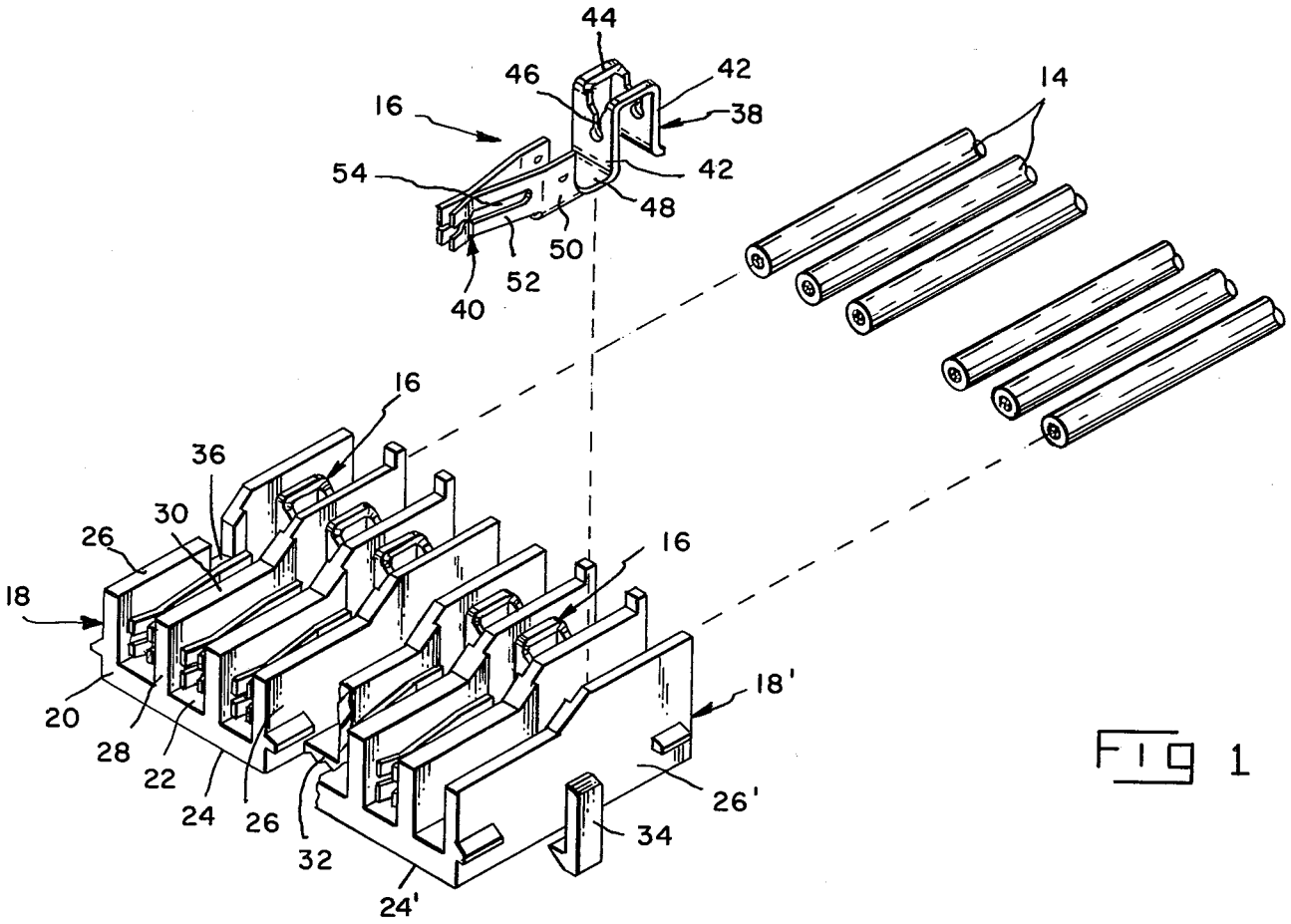
FIG. 1 is a perspective view showing a pair of connector modules in accordance with the invention, wires aligned with the terminals in the modules, and showing one of the terminals exploded from its module.
Figure 2:
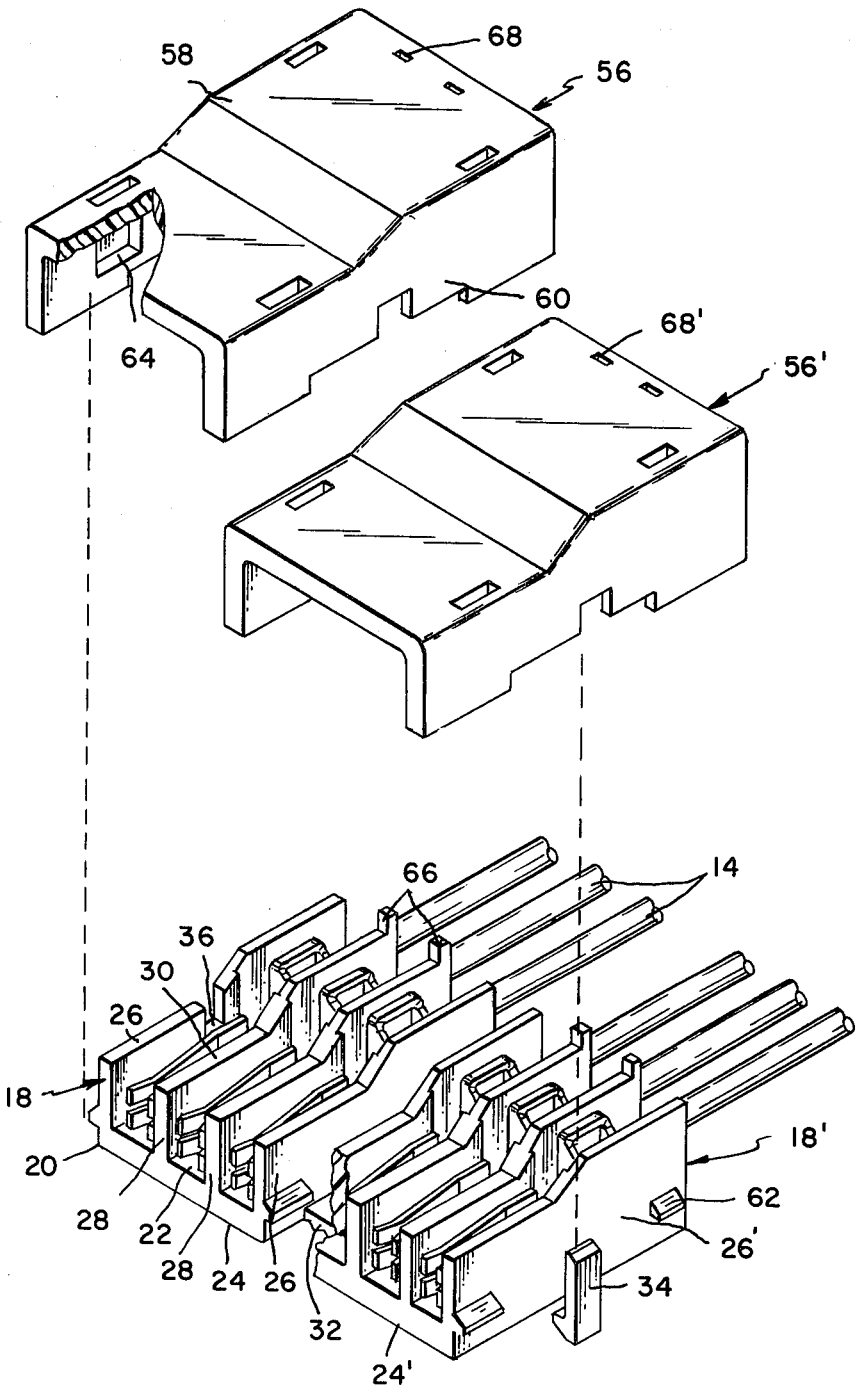
FIG. 2 is a view similar to FIG. 1 showing the wires connected to the terminals and showing cover members in alignment with the modules in preparation for assembly of the covers to the modules.

As shown best in FIG. 1, the connector assembly comprises a pair of similar connector housing modules 18, 18' which are in side-by-side relationship and which are connected to each other by hinge means 32. Since the modules are similar, the same reference numerals, differentiated by prime marks, will be used to identify corresponding parts of the two modules and only the module 18 will be described in detail.

The module 18 is a molded thermoplastic material and comprises a generally rectangular barrier wall portion 20 having upwardly and downwardly facing major surfaces 22, 24. Endwall portions 26 extend upwardly from the end edges of the wall portion 20 above the surface 22 and separate cavity walls 28 extend from the surface 22 between the endwall portions 26. The endwall portions and the cavity walls define spaced-apart cavities, each of which contains one of the contact terminals 16. The upper ends of the endwall portions 26 and the cavity walls constitute a module sidewall 30 which is interrupted by the cavities which extend inwardly through this sidewall.

Figure 4:
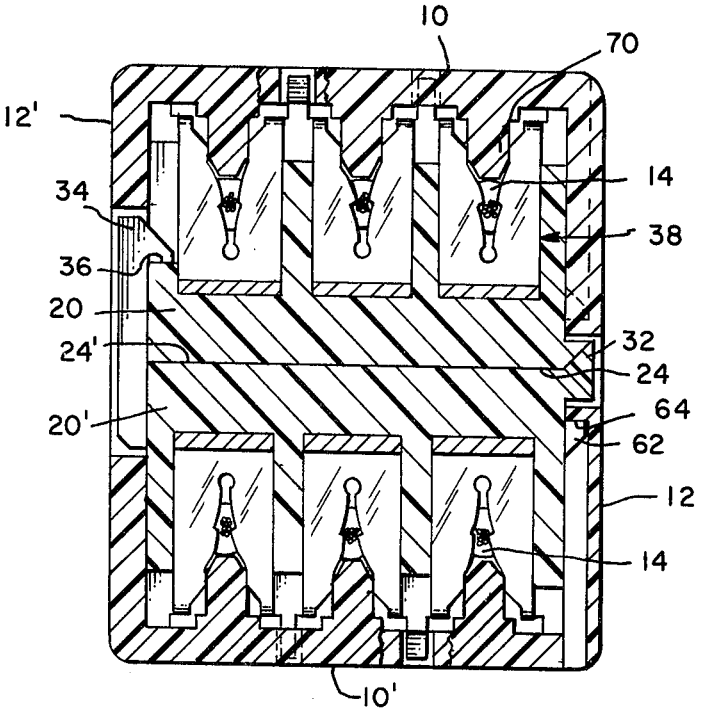
FIG. 4 is a cross-sectional view taken along the lines 4–4 of FIG. 3.

The hinge means 32 is constructed such that the two modules 18, 18' can be folded towards each other until the surfaces 24, 24' are against each other thereby to form the housing for a two row electrical connector, as shown in FIG. 4. In order to retain the two modules against each other, the module 18' is provided with a latch arm 34 extending from one of its endwall portions and the corresponding endwall portion of the module 18 is provided with a notch 36 which receives the hook-like end of the arm 34.

The individual terminals 16 are stamped and formed sheet metal and have a wire-connecting portion 38 and a contact portion 40. The wire-connecting portion 38 comprises a pair of parallel plate sections 42 connected at their ends by spaced-apart integral strips 44. These plate sections have wire receiving slots 46 so that a wire can be connected to each terminal by moving the wire laterally of its axis and into the slots 46 of the plate members.

The contact section 40 comprises a pair of spring members 52 which extend from flanges 50 on the end of connecting section 48 which in turn extends to the adjacent plate member 42. The contact spring members 52 are designed to receive a tab-like terminal between their opposed surfaces and alternatively, to receive a tab in slots 54 which extend inwardly from the ends of these spring members. The terminals may be secured in the cavities by any suitable means, for example, by simply providing an interference fit of each terminal in its cavity, or alternatively, by providing suitable retaining lance means.

Prior to folding of the modules 18, 18' against each other, the wires 14 are connected to the terminals by simply aligning a wire with each of the terminals and moving the wires laterally into the wire-receiving slots of the terminals. As will be discussed below, this operation can be carried out by anyone of a variety of known machines or tools.

After the wires have been connected to the terminals, cover member 56, 56' are assembled to the modules. These cover members are generally channel-shaped and comprise a web 58 and flanges 60. As will be apparent from the drawing, the cover members are dimensioned to fit relatively snugly over the modules with the web portions 58 against the module sidewalls 30. The cover members thus close off the open upper ends, as viewed in the drawing, of the cavities. The cover members are retained on the modules by latching means, such as suitable latching ears 62 on the external surfaces of the endwall portions and openings or recesses 64 in the internal surfaces of the flanges 60, these recesses providing shoulders for engaging with the ears 62, as illustrated in FIG. 4. Additionally, ears 66 extend from the cavity walls and are received in complementary openings 68 in the web portions of the covers. These ears and openings further stabilize the cover members on the modules.

After assembly of the cover members to the modules, the modules are folded, as previously described, against each other until the latch arm 34 of the module 18' engages the shoulder 36 of the module 18. The connector will then be in its fully assembled form, as shown in FIGS. 3 and 4.

The cover members 56, 56' of the disclosed embodiment have spaced-apart projections 70 on the internal surfaces of their web portions, these projections being contoured to enter the wire-receiving slots in the terminals and to engage the wire after the wire has been fully inserted and retain it in the wire-receiving slot of the terminal. If desired, these projections can serve to push the wires into the slots; that is, the wires can be located in the slots without being fully inserted and upon assembly of the cover members to the modules, the wires will be completely inserted into the wire-receiving slots 46 by the projections 70.

The modules 18, 18' are produced in the form shown in FIG. 1, that is, in side-by-side relationship so that the terminals in the two modules are all arranged in a row. A pair of modules in this form can thus be processed in a machine of the above identified type, disclosed in U.S. Pat. No. 4,043,017. The wires may be inserted into the terminals by the insertion punches of the apparatus and, if desired, the modules can then be removed from the apparatus and the cover assembly and folding operations carried out manually. Alternatively, the cover assembly operations and folding operations can also be carried out in subsequent assembly and folding stations of a machine, thereby to render the entire process fully automatic.

A pair of modules, as shown in FIG. 1, can also be used in the manufacture of electrical harnesses, as described in the above identified U.S. Pat. No. 3,859,724. The modules would be located on the harness board at locations where a two row connector is required. The wires can then be laced over the harness board and positioned in alignment with terminals. As was explained in the above identified U.S. patent, the wires are then inserted by a portable tool while the connector is on the harness board and the modules are thereafter assembled to each other by folding and the cover members of the assembled to the modules.

A salient advantage of the invention is that recently developed manufacturing techniques for harness making and for the manufacture of harness subassemblies can now be practiced with modules, in accordance with the invention, to produce two row electrical connectors in the harness rather than only single row connectors. It will, of course, be obvious that connector modules, in accordance with the invention, can also be used in other manufacturing processes in which the wires are inserted with simple bench presses or hand tools.

I claim:

1. A method of manufacturing a two-row electrical connector adapted to be mated with a complementary two-row electrical connector of the type comprising an insulating housing having a mating face and a wire entry face, said faces being oppositely directed, spaced-apart endwalls and spaced-apart sidewalls extending between said faces, a plurality of terminal-receiving cavities extending through said housing from said wire entry face to said mating face and a contact terminal in each of said cavities, said cavities and said terminals being arranged in two parallel rows which extend between said endwalls, said method comprising the steps of:

positioning a pair of connector modules, of the type having a single row of terminals therein, in side-by-side relationship with the terminals in the two modules arranged as a single row, locating a plurality of wires in side-by-side relationship in a single plane with each wire in alignment with one of said terminals, moving said wires laterally to their axis in a single direction to the terminals and connecting said wires to said terminals, subsequently, positioning said modules against each other in aligned relationship and with said terminals in said modules forming two parallel rows and with all terminals having the same orientation, and securing said modules to each other thereby forming a wired two-row electrical connector.

2. A method as set forth in claim 1 including the step of assembling housing cover means to said modules.

3. A method as set forth in claim 2 in which said housing means is assembled to said modules prior to the step of positioning said modules against each other.

4. A method as set forth in either of claims 1 or 2 in which the wires are connected to the terminals by moving the wires laterally of their axes and into wire-receiving slots in the terminals.

5. A method as set forth in claim 4 in which the modules are secured to each other by engaging a latching arm on at least one of the modules with the other module.

6. A method as set forth in claim 2 in which the cover means are secured to the modules by providing for each module a channel-shaped cover member having a web base and sidewalls formed by flanges upstanding from the web and positioning each module between the side flanges of its associated cover member and against the web of its associated cover member.

* * * * *